US007404865B2

(12) United States Patent
Izumida et al.

(10) Patent No.: US 7,404,865 B2
(45) Date of Patent: Jul. 29, 2008

(54) STEEL WIRE FOR HEAT-RESISTANT SPRING, HEAT-RESISTANT SPRING AND METHOD FOR PRODUCING HEAT-RESISTANT SPRING

(75) Inventors: Hiromu Izumida, Itami (JP); Nozomu Kawabe, Itami (JP); Teruyuki Murai, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 64 days.

(21) Appl. No.: 10/473,355

(22) PCT Filed: Jan. 24, 2002

(86) PCT No.: PCT/JP02/00525

§ 371 (c)(1),
(2), (4) Date: Sep. 30, 2003

(87) PCT Pub. No.: WO03/062483

PCT Pub. Date: Jul. 31, 2003

(65) Prior Publication Data

US 2004/0099354 A1 May 27, 2004

(51) Int. Cl.
*C21D 9/02* (2006.01)
*C22C 38/58* (2006.01)

(52) U.S. Cl. ..... 148/325; 148/580

(58) Field of Classification Search ..... 148/327, 148/325, 580; 420/46–48, 65
See application file for complete search history.

(56) References Cited

U.S. PATENT DOCUMENTS 3,377,828 A * 4/1968 Harmon ..... 72/2

(Continued)

FOREIGN PATENT DOCUMENTS

FR 2609125 A * 7/1988

(Continued)

OTHER PUBLICATIONS

Machine—English translation of Japanese patent 2000-239804, Sumitomo Electric Industry LTD, Sep. 5, 2000.*

(Continued)

*Primary Examiner*—John P. Sheehan
*Assistant Examiner*—Jessee Roe
(74) *Attorney, Agent, or Firm*—McDermott Will & Emery LLP

(57) ABSTRACT

A high-strength steel wire for heat-resistant springs has both excellent high-temperature tensile strength and excellent high-temperature sag resistance at a temperature as high as 350 to 500° C., particularly at 400° C. or so (these properties are needed for spring materials). The steel wire contains (a) 0.01 to 0.08 wt % C, 0.18 to 0.25 wt % N, 0.5 to 4.0 wt % Mn, 16 to 20 wt % Cr, and 8.0 to 10.5 wt % Ni, (b) at least one constituent selected from the group consisting of 0.1 to 3.0 wt % Mo, 0.1 to 2.0 wt % Nb, 0.1 to 2.0 wt % Ti and 0.3 to 2.0 wt % Si, and (c) mainly Fe and unavoidable impurities both of which constitute the remainder. The steel wire has (a) a tensile strength of at least 1,300 N/mm$^2$ and less than 2,000 N/mm$^2$ before being treated with low-temperature annealing, and (b) a maximum crystal-grain diameter of less than 12 μm in the γ phase (austenite) in a transverse cross section of the wire.

6 Claims, 1 Drawing Sheet

U.S. PATENT DOCUMENTS

| | | | | |
|---|---|---|---|---|
| 4,246,047 | A | 1/1981 | Yamamoto et al. | |
| 4,877,462 | A * | 10/1989 | Sugita | 148/253 |
| 5,368,656 | A * | 11/1994 | Heitmann et al. | 148/333 |
| 6,341,662 | B1 * | 1/2002 | Karlsson | 181/230 |

FOREIGN PATENT DOCUMENTS

| | | | |
|---|---|---|---|
| JP | 54-18648 | | 7/1979 |
| JP | 59-32540 | | 8/1984 |
| JP | 4-297555 | A | 10/1992 |
| JP | 5-279802 | A | 10/1993 |
| JP | 07-113144 | | 9/1995 |
| JP | 09-202942 | | 8/1997 |
| JP | 11-12695 | A | 1/1999 |
| JP | 11-012695 | | 4/1999 |
| JP | 11-92882 | A | 4/1999 |
| JP | 411092882 | * | 4/1999 |
| JP | 2000-239804 | * | 9/2000 |
| JP | 2000-239804 | A | 9/2000 |
| JP | 2000-309850 | A | 11/2000 |

OTHER PUBLICATIONS

ASM Handbook vol. 1 (1990) pp. 723-728.*
ASM Handbook vol. 4 (1991) p. 43.*
http://en.wikipedia.org/wiki/Image:Normal_distribution_and_scales.gif.*

* cited by examiner

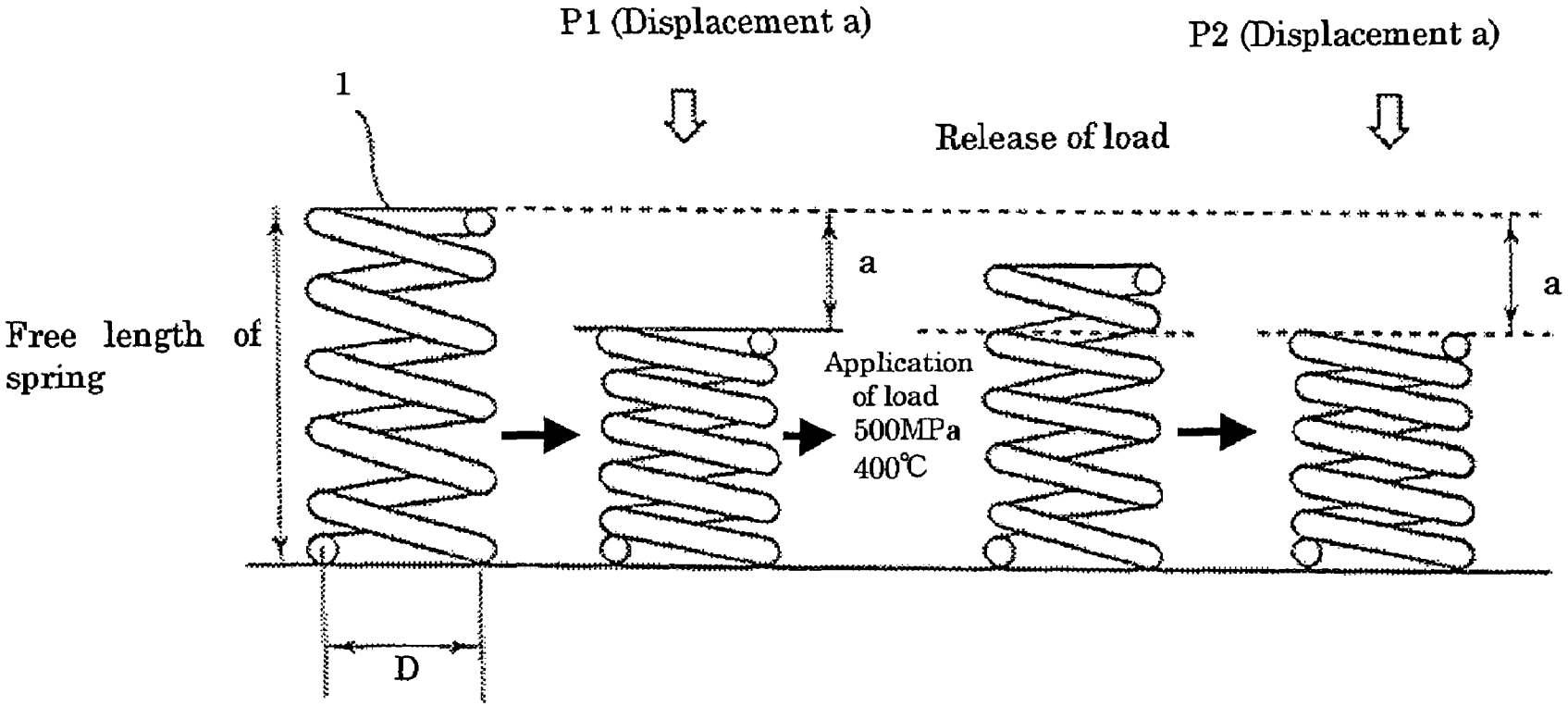
P1 (Displacement a)
P2 (Displacement a)
Release of load
Application of load 500MPa 400℃
a
a
1
D
Free length of spring

STEEL WIRE FOR HEAT-RESISTANT SPRING, HEAT-RESISTANT SPRING AND METHOD FOR PRODUCING HEAT-RESISTANT SPRING

TECHNICAL FIELD

The present invention relates to a steel wire for heat-resistant springs, a heat-resistant spring, and a method for producing the heat-resistant spring, and particularly to a steel wire having a γ-phase (austenitic) structure to be used as a material for heat-resistant parts such as a part for the exhaust system of a car engine, particularly a spring.

BACKGROUND ART

As a material for springs used in the exhaust system of a car engine, austenitic stainless steels referred to as heat-resistant steels, such as SUS 304, SUS 316, and SUS 631J1 (JIS), or precipitation-hardened stainless steels have been used at an operating temperature of 350° C. or below.

In recent years, demands for more stringent control of the exhaust gas of automobiles have been increasing as a measure for environmental protection. The increasing demands have brought a tendency to raise the temperature of the exhaust system in order to increase the efficiency of engines and catalysts. Along with other parts, the springs are affected by this temperature rise. As a result, the most widely used austenitic stainless steels, such as SUS 304 and SUS 316, are sometimes insufficient in heat-resistant quality, particularly high-temperature tensile strength and high-temperature sag resistance especially needed for heat-resistant springs.

To avoid this problem, precipitation-hardened austenitic stainless steels such as SUS 631 are used as the material for the spring. However, the precipitation-hardened austenitic stainless steels have a problem in that a yield decrease in the hot working increases the cost, and an aging heat treatment at high temperatures for prolonged periods increases the production cost.

Consequently, the heat-resistant quality has been improved by employing the solid solution hardening which treats the steel by adding elements that form an interstitial solid solution, such as C and N, and ferrite-forming elements, such as W, Mo, V, Nb, and Si.

As a prior art that performs the solid solution hardening by adding the fore-going element, the published Japanese patent application Tokukoushou 54-18648 has disclosed a technique that intends to combine the anti-corrosion property of SUS 316 and the tensile strength of SUS 304.

Another published Japanese patent application, Tokukoushou 59-32540, has disclosed a technique in which in order to increase high-temperature tensile strength, high-temperature yield strength, and high-temperature oxidation resistance particularly at a temperature of 700° C. or so, the solid solution hardening is performed not only by the addition of C and N but also by the combined addition of B and V to an austenitic steel containing a large amount of Mn.

Yet another published Japanese patent application, Tokukaihei 4-297555, has disclosed a technique in which in order to attain high tensile strength and a long creep rapture life particularly at a temperature as high as 900° C. or so, the solid solution hardening is performed by the addition of C, N, Nb, W, etc.

Yet another published Japanese patent application, Tokukaihei 11-12695, has disclosed a technique which improves the performance of heat-resistant springs by mainly employing N to form a solid solution. Aiming at raising the elastic limit of SUS 316N, which is standardized in the Japanese Industrial Standard (JIS), by wire drawing, this technique has achieved not only a high elastic limit but also a high fatigue limit and a good heat-resistant quality at high temperatures by annealing a material containing a large amount of N.

Yet another published Japanese patent application, Tokukai 2000-239804, has disclosed a technique which achieves high sag resistance by the addition of elements, by the control of the average crystal-grain diameter in the γ phase (austenite) through the regulation of the heat-treatment conditions, and by the control of the aspect ratio (major-axis/minor-axis ratio) of the crystal grains in a longitudinal cross section of the wire through the regulation of the reduction rate of the cross-sectional area (hereinafter referred to as a "reduction of area") at the time of wire drawing.

However, the three techniques disclosed by Tokukoushou 54-18648, Tokukoushou 59-32540, and Tokukaihei 4-297555 do not intend to improve the high-temperature sag resistance needed for heat-resistant springs at a temperature of 350 to 500° C., particularly at 400° C. or so. The technique disclosed by Tokukaihei 11-12695 limits the Ni equivalent in addition to the specification of the containing range of the material elements. However, the Cr equivalent, also, must be considered to stabilize the γ phase (austenite). This technique has a drawback of high production cost because it uses a large amount of costly Mo as an additive to a material based on SUS 316 containing a large amount of costly Ni. The method of controlling the structure disclosed by Tokukai 2000-239804 is insufficient in considering the conditions for the solution treatment and the reduction of area. As a result, uneven plastic deformation occurs locally, and the performance of the drawn material may not be improved.

The heat-resistant quality of the heat-resistant steel treated by the solid solution hardening with N varies with the heat-treating conditions and the reduction of area. In particular, when the solid solution hardening with N is performed, the degree of hardening depends largely on uneven plastic deformation caused by the coiling process, for example. Therefore, it is necessary to properly specify the structure and the production conditions in order to attain the high-temperature tensile strength and the high-temperature sag resistance needed for heat-resistant springs.

DISCLOSURE OF INVENTION

An object of the present invention is to offer a high-strength steel wire for heat-resistant springs, particularly a steel wire having an excellent high-temperature sag resistance at a temperature as high as 350 to 500° C., particularly at 400° C. or so (the resistance is needed for heat-resistant springs). Another object of the present invention is to offer a heat-resistant spring produced by using the foregoing steel wire, particularly a spring having an excellent heat-resistant quality. Yet another object is to offer a method for producing the heat-resistant spring.

According to the present invention, the steel wire for heat-resistant springs attains the foregoing object both by the stabilization of the γ phase (austenite) through the addition of a comparatively large amount of N to an Fe-based austenitic stainless steel and by performing the solid solution hardening with elements that form an interstitial solid solution, such as N, and ferrite-forming elements, such as Mo, Nb, Ti, and Si.

According to the present invention, the steel wire for heat-resistant springs contains the following constituents:

(a) 0.01 to 0.08 wt % C, 0.18 to 0.25 wt % N, 0.5 to 4.0 wt % Mn, 16 to 20 wt % Cr, and 8.0 to 10.5 wt % Ni;

(b) at least one constituent selected from the group consisting of 0.1 to 3.0 wt % Mo, 0.1 to 2.0 wt % Nb, 0.1 to 2.0 wt % Ti and 0.3 to 2.0 wt % Si; and (c) mainly Fe and unavoidable impurities both of which constitute the remainder.

The steel wire has the following properties:

(a) a tensile strength of at least 1,300 N/mm$^2$ and less than 2,000 N/mm$^2$ before being treated by low-temperature annealing; and (b) a maximum crystal-grain diameter of less than 12 μm in the γ phase (austenite) in a transverse cross section of the wire.

In the present invention, the term "transverse cross section" is used to mean a cross section perpendicular to the direction of the wire drawing.

When contained in a γ-phase (austenitic) matrix, elements that form an interstitial solid solution, such as C and N, not only perform the solid solution hardening, which hardens the steel by producing strain in the crystal lattice, but also have an effect of fixing the dislocation in the structure (Cottrell effect: a state in which solute atoms congregate around the dislocation due to the elastic interaction between the dislocation and the solute atoms, and the state is stable in terms of energy). In addition, the solid solution hardening by the addition of ferrite-forming elements, such as Mo, Nb, Ti, and Si, enables the attainment of excellent heat-resistant quality even at a temperature as high as 350 to 500° C., particularly at 400° C. or so. The foregoing effect of fixing the dislocation (Cottrell effect) is further promoted by performing low-temperature annealing after the spring-forming process such as coiling (the annealing also relieves the strain). In particular, when the low-temperature annealing is conducted at a temperature of 500 to 550° C., the strength can be increased by 15% or more. As a result, the steel wire has an excellent high-temperature sag resistance.

According to the present invention, the steel wire for heat-resistant springs is produced by controlling the maximum crystal-grain diameter in the γ phase (austenite) to fall in the range of less than 12 μm in a transverse cross section of the steel wire. This control decreases the concentration of the stress and thereby improves the high-temperature sag resistance. The present inventors found that variations of the crystal size in the structure largely affects the heat-resistant quality of the spring used in the exhaust system of a car, in which the increase and decrease in the stress applied at high temperatures are repeated in a relatively short period. For example, when an extremely larger crystal than other crystals is present singly in a structure, the coarse crystal creates stress concentration because of its low strength. As a result, the coarse crystal becomes the source of a local sag (plastic deformation at high temperatures). This phenomenon occurs even when the other crystals than the coarse crystal have an extremely fine structure and high strength. Therefore, the generation of such a local sag becomes fatal in parts such as a spring to which stress is applied over a comparatively wide area. Considering this phenomenon, the present inventors improve the high-temperature sag resistance through the control of the maximum crystal-grain diameter in the γ phase (austenite) so as to reduce the stress concentration.

According to the present invention, the maximum crystal-grain diameter of less than 12 μm in the γ phase (austenite) is attained by controlling the conditions for the solution treatment and wire drawing. More specifically, the temperature for the solution treatment is relatively reduced to decrease the average crystal-grain diameter, and the treating temperature is maintained for a sufficiently long period to uniformly heat the entire steel wire so that the variations of the crystal-grain diameters can be reduced. However, the temperature-maintaining period has an upper limit to avoid excessive growth of the crystal grains. The reduction of area at the time of wire drawing is properly selected according to the requirement.

(Conditions for the Solution Treatment)

It is desirable that the solution treatment be performed at a temperature of 950 to 1,200° C., more desirably at 950 to 1,100° C. It is desirable that the temperature-maintaining period be controlled at 0.3 to 5 min/mm when expressed by the ratio "maintaining period (min)/wire diameter (mm)." A high-speed heating method such as high-frequency heating can achieve the uniform heating of the entire steel wire and the suppression of the growth of the crystal grains. It is desirable that the temperature be raised at a rate of 300 to 2,000° C./min. As the treating temperature is increased and the temperature-maintaining period is elongated, the crystal grain grows, increasing its diameter. The variations of the grain diameters are produced by the variations of the local temperatures in the furnace and by the temperature gradient from the surface to the center of the wire, depending on the wire diameter. In view of these phenomena, the present invention suppresses the growth of the crystal grains and the variations of the grain diameters through the foregoing control of the treating temperature and the temperature-maintaining period.

(Reduction of Area)

It is desirable that the final reduction of area at the time of wire drawing be controlled at 50% to 70%, more desirably at 55% to 65%. The reduction of area of at least 50% is specified because when the reduction is less than 50%, a sufficiently high elastic limit cannot be achieved and accordingly a sufficient high-temperature sag resistance cannot be attained. The reduction of area of at most 70% is specified because when the reduction is more than 70%, excessive dislocations are generated and accordingly a sufficient high-temperature sag resistance cannot be attained.

It is possible that the tensile strength of the steel wire is affected by the control of the crystal-grain diameter in the γ phase (austenite) through the regulation of the conditions for the solution treatment and of the reduction of area at the time of wire drawing. Considering this influence, the present invention specifies that the tensile strength must be at least 1,300 N/mm$^2$, which is the allowable lower limit for the production of a spring, and less than 2,000 N/mm$^2$, which is the allowable upper limit to secure the toughness needed for the production of a spring. In the present invention, the tensile strength of the steel wire is defined as the strength measured at room temperature after the solution treatment and wire drawing and before the spring formation and low-temperature annealing.

According to the present invention, it is desirable that the steel wire for heat-resistant springs further contain 0.2 to 2.0 wt % Co. When Co is contained, the precipitation of intermetallic compounds is promoted, and consequently the high-temperature sag resistance can further be improved.

According to the present invention, the steel wire for heat-resistant springs has a surface roughness, expressed as Rz, of 1 to 20 μm. The term "Rz" denotes the average value of ten measurements stipulated in JIS B0601-1994. The steel wire is required to have the foregoing surface roughness to exercise its heat-resistant quality in addition to the sufficient performance for the spring, such as the fatigue resistance as a spring characteristic. The reason why the present invention specifies that the steel wire have a surface roughness, Rz, of at most 20 μm is explained below. In the spring used in the exhaust system of a car, in which the increase and decrease in the stress applied at high temperatures are repeated in a relatively short period, stress concentration is produced at flaws on the surface of the spring. As a result, a local sag is produced. In other words, the surface flaw of the spring causes a local sag. Consequently, the present invention alleviates the stress concentration after the spring formation by reducing the surface roughness of the steel wire. The surface roughness Rz of 20 μm or less is achieved by the conventional production control, such as the control of the conditions for wire drawing, including the die structure and drawing speed, and the handling of the steel wire during the heat treatment. In addition, it is desirable to reduce the roughness by electrolytic polishing. Theoretically, small roughness is desirable. However, the surface-smoothing operation usually requires a considerably high cost. Therefore, the present invention specifies the surface roughness Rz of at least 1 μm in order to prevent a further increase in cost. In the present invention, the surface roughness of the steel wire is defined as the roughness in the direction of wire drawing.

The foregoing structural control of the γ-phase (austenitic) matrix can be performed even when the steel wire has a deformed transverse cross section, such as a square, rectangular, trapezoidal, elliptical, or oval cross section.

The steel wire of the present invention for heat-resistant springs is suitable for producing a heat-resistant spring that is required to have heat-resistant quality.

According to the present invention, the method for producing a heat-resistant spring properly specifies the conditions for the heat treatment in order to obtain a spring having an excellent sag resistance even at high temperatures. More specifically, the production method comprises the following steps:

(a) formation of a spring by using the above-described steel wire; and (b) low-temperature annealing of the spring at a temperature of 450 to 600° C.

The specification of the annealing temperature at a temperature higher than the operating temperature promotes the strain aging so as to prevent the movement of the dislocation at high temperatures or to fix nearly all of the dislocations. In other words, in the production method of the present invention, the dislocation introduced into the structure through the plastic processing, such as wire drawing and spring formation, is fixed by forming a Cottrell effect (fixation of the dislocation) with the help of C and N through the annealing at a proper temperature. The hardening of the structure by the formation of the Cottrell effect enables the production of a heat-resistant spring having an excellent sag resistance even at a temperature as high as 350 to 500° C., particularly at 400° C. or so.

It is more desirable that the low-temperature annealing be performed at a temperature of 500 to 550° C. This low-temperature annealing can increase the tensile strength of the steel wire by at least 15%. The increase in the tensile strength can be used as a measure to confirm the formation of the Cottrell effect. The heat-resistant spring whose tensile strength is increased by at least 15% has a Cottrell effect and consequently has excellent high-temperature sag resistance.

According to the present invention, it is desirable that the low-temperature annealing be performed at a temperature of 450 to 600° C. for 10 to 60 minutes, more desirably for 15 to 30 minutes. It is known that when Ni plating is conducted with a thickness of 1 to 3 μm or so on the surface of a steel wire rod or steel wire having a structure hardened by such a method as described above, the processibility of wire drawing and spring formation is improved. This Ni plating can also be applied to the surface of the steel wire of the present invention to improve the processibility without adversely affecting the improvement of the heat-resistant quality.

In the steel wire of the present invention for heat-resistant springs, the basis for the selection of the constituting elements and the limitation of their contents is explained below.

The element C forms an interstitial solid solution in a crystal lattice, introducing strain to increase the strength. It forms a Cottrell effect, which fixes the dislocation in the structure. It forms carbides by combining with Cr, Nb, Ti, and other elements in the steel to increase the high-temperature strength. When it forms fine precipitates together with Nb, Ti, and other elements, it can suppress the growth of the crystal grains, improving the high-temperature sag resistance. However, when chromic carbides are present at crystal boundaries, Cr-deficient regions are created around the crystal boundaries because of the low diffusion speed of the Cr in the γ phase (austenite). As a result, the toughness and corrosion resistance are decreased. This phenomenon can be suppressed by the addition of Nb and Ti. However, when Nb, Ti, and other additive elements are excessively present, they cause the γ phase (austenite) to be unstable. Consequently, 0.01 to 0.08 wt % C is specified as an effective content.

As with C, the element N forms an interstitial solid solution to increase the strength. It also forms a Cottrell effect. It forms nitrides by combining with Cr, Nb, Ti, and other elements in the steel to increase the high-temperature strength. When it forms fine precipitates together with Nb, Ti, and other elements, it can suppress the growth of the crystal grains, improving the high-temperature sag resistance. However, the formation of the solid solution in the γ phase (austenite) has a limitation. Its excessive addition in excess of 0.20 wt %, especially of 0.25 wt %, causes the generation of blowholes at the time of melting and casting. This phenomenon can be suppressed to a certain extent by adding elements having high affinity with N, such as Cr and Mn, to increase the solubility limit. However, when N is excessively added, stringent temperature and atmosphere controls are required at the time of melting, possibly increasing the cost. Consequently, 0.18 to 0.25 wt % N is specified.

The element Mn is used as a deoxidizer at the time of melting and refining. It is also effective in stabilizing the phase of the γ phase (austenite) of an austenitic stainless steel. Consequently, it can be a substitute element for costly Ni. As described above, it can increase the solubility limit of N into the γ phase (austenite). However, it adversely affects the oxidation resistance at high temperatures. Consequently, 0.5 to 4.0 wt % Mn is specified. Nevertheless, when the prime importance is placed on the corrosion resistance, it is desirable to add 0.5 to 2.0 wt % Mn. On the other hand, in order to increase the solubility limit of N, i.e., to minimize the formation of microblowholes of nitrogen, it is effective to add 2.0 to 4.0 wt % Mn. In this case, however, the corrosion resistance is decreased slightly. In view of these effects, it is desirable to adjust the amount of addition in accordance with the application.

The element Cr is one of the principal constituents of an austenitic stainless steel. It is an effective element in attaining heat-resistant quality and oxidation resistance. First, an Ni equivalent and a Cr equivalent are calculated from the other constituent elements in the steel wire of the present invention. Then, in view of the phase stability of the γ phase (austenite), 16 wt % or more Cr is specified to attain the required heat-resistant quality. In view of the toughness deterioration, 20 wt % or less Cr is specified. Here, the Ni equivalent (%) can be obtained by calculating the formula Ni %+0.65 Cr %+0.98 Mo %+1.05 Mn %+0.35 Si %+12.6 C %, for example. The Cr equivalent (%) can be obtained by calculating the formula Cr %+1.72 Mo %+2.09 Si %+4.86 Nb %+8.29 V %+1.77 Ti %+21.4 Al %+40 B %−7.14 C %−8.0 N %−3.28 Ni %−1.89 Mn %−0.51 Cu %, for example. The element Ni is effective in stabilizing the γ phase (austenite). In the present invention, however, when N is contained in excess of 0.2 wt %, a large amount of Ni causes the generation of blowholes. In this case, it is effective to add Mn, which has high affinity with N. It is necessary to add Ni in view of the amount of Mn addition so as to obtain an austenitic stainless steel. Consequently, 8.0 wt % or more Ni is specified to stabilize the γ phase (austenite), and 10.5 wt % or less Ni is specified to suppress both the generation of blowholes and the cost increase. Although 8.0 to 10.5 wt % Ni is specified as a desirable content as described above, when the upper limit of Ni content is reduced to 10.0 wt %, N can more readily form a solid solution particularly in the melting and casting processes. Therefore, this reduced content range is advantageous in further reducing the cost. The present invention specifies the above-described Ni content in view of the suppression of both the formation of blowholes and the cost increase. However, even when an Ni content of 10.0 to 14.0 wt % is employed as in SUS 316, which has higher austenite stability, the excellent high-temperature sag resistance such as that attained in the present invention can obviously be achieved.

The element Mo forms a substitutional solid solution in the γ phase (austenite) and considerably contributes to the improvement of high-temperature tensile strength and high-temperature sag resistance. Consequently, at least 0.1 wt % Mo is specified because this amount is necessary to improve the high-temperature sag resistance, and at least 3.0 wt % Mo is specified to prevent the decrease in processibility.

As with Mo, the element Nb forms a solid solution in the γ phase (austenite) and considerably contributes to the improvement of the high-temperature tensile strength and high-temperature sag resistance. As described above, it has high affinity with N and C, and contributes to the improvement of the high-temperature sag resistance by minutely precipitating in the γ phase (austenite). It is also effective in suppressing the growth of the crystal grains and in suppressing the precipitation of chromic carbides in grain boundaries. However, if excessively added, it precipitates the $Fe_2Nb$ phase (Laves phase), possibly decreasing the strength. Consequently, 0.1 to 2.0 wt % Nb is specified.

As with Mo, Nb, and the below-described Si, the element Ti is a ferrite-forming element. It forms a solid solution in the γ phase (austenite) and therefore can improve the heat-resistant quality. It, however, adversely affects the stability of the γ phase (austenite). Consequently, 0.1 to 2.0 wt % Ti is specified.

The element Si forms a solid solution and thereby improves the heat-resistant quality. It is also effective as a deoxidizer at the time of melting and refining. In the present invention, at least 0.3 wt % Si is specified because this amount is necessary to achieve the required heat-resistant quality through the solid solution hardening. At most 2.0 wt % Si is specified in order to avoid the decrease in toughness.

The elements Co forms a γ phase (austenite). Its solid solution hardening is less effective than the above-described ferrite-forming elements, such as Mo, Nb, Ti, and Si. Nonetheless, it forms intermetallic compounds and thereby produces precipitation hardening. This precipitation hardening considerably improves the high-temperature heat-resistant quality to the extent comparable to that attained by the addition of ferrite-forming elements. However, its excessive addition decreases resistance against sulfuric acid and nitric acid and resistance to atmospheric corrosion. Consequently, 0.2 to 2.0 wt % Co is specified.

BRIEF DESCRIPTION OF DRAWING

FIGURE is a diagram illustrating a test method for evaluating the sag resistance of a steel wire.

BEST MODE FOR CARRYING OUT THE INVENTION

Embodiments of the present invention are explained below.

The steel products having the chemical compositions (wt %) shown in Table 1 were melted and cast. The cast bodies were forged and hot-rolled. Subsequently, the solution treatment and the wire drawing were repeated (the wire temperature at the time of drawing was 50 to 200° C.). Finally, test pieces having a wire diameter of 3.0 mm were obtained at a reduction of area of about 60%. Table 1 shows the chemical composition, tensile strength, and maximum crystal-grain diameter in the γ phase (austenite) of the test pieces. In Table 1, Comparative samples 1 and 2 are made of SUS 304-WPB and SUS 316-WPA, respectively, both of which are ordinary heat-resistant stainless steels. The maximum crystal-grain diameter in the γ phase (austenite) was measured by using optical micrographs of a transverse cross section of a steel wire which were taken after the cross section was electrolytically etched.

TABLE 1

| | Fe | C | N | Mn | Cr | Ni | Mo | Nb | Ti | Si | Co | Tensile strength ($N/mm^2$) | Max. grain diameter (μm) |
|---|---|---|---|---|---|---|---|---|---|---|---|---|---|
| Invented sample 1 | Remainder | 0.04 | 0.20 | 2.0 | 19.0 | 9.0 | 0.5 | — | — | — | — | 1,652 | 11.4 |
| Invented sample 2 | Remainder | 0.07 | 0.20 | 1.2 | 18.0 | 8.0 | — | 0.8 | — | — | — | 1,648 | 11.2 |
| Invented sample 3 | Remainder | 0.07 | 0.20 | 3.0 | 18.0 | 9.5 | — | — | 0.8 | — | — | 1,702 | 11.5 |
| Invented sample 4 | Remainder | 0.07 | 0.20 | 2.5 | 19.0 | 9.0 | 1.0 | — | — | 1.1 | — | 1,672 | 11.3 |
| Invented sample 5 | Remainder | 0.06 | 0.20 | 2.5 | 19.0 | 9.0 | 1.5 | — | — | 1.1 | 0.5 | 1,654 | 11.1 |
| Invented sample 6 | Remainder | 0.05 | 0.25 | 1.2 | 18.0 | 8.0 | 2.0 | — | — | 1.1 | — | 1,691 | 11.1 |
| Invented sample 7 | Remainder | 0.07 | 0.20 | 2.0 | 19.0 | 9.0 | 1.0 | — | — | — | — | 1,682 | 8.7 |
| Comparative sample 1 | Remainder | 0.06 | 0.02 | 1.5 | 18.0 | 8.1 | — | — | — | 0.6 | — | 1,672 | 11.3 |

TABLE 1-continued

| | Fe | C | N | Mn | Cr | Ni | Mo | Nb | Ti | Si | Co | Tensile strength ($N/mm^2$) | Max. grain diameter (μm) |
|---|---|---|---|---|---|---|---|---|---|---|---|---|---|
| Comparative sample 2 | Remainder | 0.06 | 0.02 | 1.5 | 16.1 | 10.0 | 2.0 | — | — | 0.5 | — | 1,451 | 11.7 |
| Comparative sample 3 | Remainder | 0.04 | 0.16 | 1.5 | 18.0 | 8.3 | 1.5 | — | — | 1.0 | 0.5 | 1,643 | 11.1 |
| Comparative sample 4 | Remainder | 0.07 | 0.20 | 2.0 | 19.0 | 9.0 | 1.0 | — | — | — | — | 1,632 | 14.6 |

The conditions of the solution treatment and the method of the tensile strength test for the test pieces of Invented samples and Comparative samples are explained below.

(Conditions of the Solution Treatment)

With Invented samples 1 to 7 and Comparative samples 1 to 3, proper temperatures were predetermined for individual test pieces from a temperature range of 950 to 1,150° C. for the solution treatment to vary the maximum crystal-grain diameter in the γ phase (austenite). The ratio "temperature-maintaining period (min)/wire diameter (mm)" was predetermined properly in accordance with the test piece from the range of 0.3 to 3.5 min/mm. As can be seen from Table 1, the foregoing range of the temperature and the temperature-maintaining period produced almost no difference in crystal-grain diameter with the difference in chemical composition.

With Comparative sample 4, the test piece was treated with a higher temperature than that of the foregoing solution treatment and a prolonged temperature-maintaining period.

In this embodiment, the surface roughness Rz in the direction of wire drawing was controlled to achieve a magnitude of 20 μm or less. This control was performed through the conventional production control, such as the control of the conditions for wire drawing, including the die structure and drawing speed, and the handling of the steel wire during the heat treatment. Invented samples 1 to 7 and Comparative samples 1 to 4 had a surface roughness, Rz, of about 15 μm in the direction of wire drawing.

(Method of the Tensile Strength Test)

The tensile strength of the steel wires after the drawing process was tested at room temperature. The test was performed after maintaining individual test pieces at room temperature for 15 minutes.

TEST EXAMPLE 1

The test pieces shown in Table 1 were subjected to an evaluation test for the high-temperature sag resistance. The test pieces were processed to form a compression coil spring. They were subjected to low-temperature annealing and Ni plating with a thickness of about 2 μm before the evaluation test was conducted. The low-temperature annealing was performed at 450° C. for 20 minutes. The details of the coil-spring shape for the test are shown below.

Wire diameter: 3 mm

Average coil diameter: 25 mm

Number of effective turns: 4.5

Free length of the spring: 50 mm (see FIG. 1)

The test method is shown in FIG. 1. The test piece was formed into a coil spring 1. A compressive load (applied shearing stress: 500 MPa) was applied to the coil spring 1 at room temperature. The loaded spring 1 was maintained at a test temperature of 400° C. for 24 hours with the strain being maintained constant. Finally, the load was released at room temperature. The amount of the sag of the spring was measured to obtain the residual shearing strain. The results are shown in Table 2.

TABLE 2

| | Annealing conditions | | Tensile strength ($N/mm^2$) | | Percentage increase | Residual shearing |
|---|---|---|---|---|---|---|
| | Temperature (° C.) | Period (min) | Before annealing | After annealing | in tensile strength (%) | strain (%) |
| Invented sample 1 | 450 | 20 | 1,652 | 1,855 | 12.3 | 0.062 |
| Invented sample 2 | 450 | 20 | 1,648 | 1,836 | 11.4 | 0.068 |
| Invented sample 3 | 450 | 20 | 1,702 | 1,915 | 12.5 | 0.062 |
| Invented sample 4 | 450 | 20 | 1,672 | 1,896 | 13.4 | 0.066 |
| Invented sample 5 | 450 | 20 | 1,654 | 1,854 | 12.1 | 0.041 |
| Invented sample 6 | 450 | 20 | 1,691 | 1,885 | 11.5 | 0.037 |
| Invented sample 7 | 450 | 20 | 1,682 | 1,886 | 12.1 | 0.038 |
| Comparative sample 1 | 450 | 20 | 1,672 | 1,752 | 4.8 | 0.128 |
| Comparative sample 2 | 450 | 20 | 1,451 | 1,500 | 3.4 | 0.101 |

TABLE 2-continued

| | Annealing conditions | | Tensile strength ($N/mm^2$) | | Percentage increase | Residual shearing |
|---|---|---|---|---|---|---|
| | Temperature (° C.) | Period (min) | Before annealing | After annealing | in tensile strength (%) | strain (%) |
| Comparative sample 3 | 450 | 20 | 1,643 | 1,786 | 8.7 | 0.087 |
| Comparative sample 4 | 450 | 20 | 1,632 | 1,818 | 11.4 | 0.091 |

The residual shearing strain (%) is calculated by using the following formula:

$$\text{Residual shearing strain}(\%)=8/\pi\times(P1-P2)\times D/(G\times d^3)\times 100,$$

where d (mm): wire diameter;

D (mm): average coil diameter (see FIG. 1);

P1 (N): load producing a stress of 500 MPa;

P2 (N): load applied to attain the displacement a (mm) after the test at 400° C.;

displacement a (mm): displacement of the coil spring when the load P1 is applied before the test at 400° C. (see FIG. 1);

G: modulus of transverse elasticity; and

P1 and P2: to be measured at room temperature.

The residual shearing strain (%) shown in Table 2 is measured after the test. A coil spring having a smaller residual shearing strain has a higher high-temperature sag resistance. The same is applied to Test examples described below.

As can be seen from Table 2, Invented samples 1 to 7 have a smaller residual shearing strain than Comparative samples 1 to 4. Comparative samples 1 and 2 are ordinary heat-resistant stainless steels. Comparative sample 3 has an N content of less than 0.18 wt %. Comparative sample 4 has a maximum crystal-grain diameter of more than 12 μm in the γ phase (austenite). This result confirms that Invented samples have high high-temperature sag resistance and hence have excellent heat-resistant quality.

The maximum crystal-grain diameter in the γ phase (austenite) decreases in the following order, for example: Comparative sample 4 (14.6 μm), Invented sample 1 (11.4 μm), Invented sample 7 (8.7 μm). In these test pieces, as the maximum crystal-grain diameter decreases, the residual shearing strain decreases, showing the increase in high-temperature sag resistance. This result confirms that when the maximum crystal-grain diameter in the γ phase (austenite) has a value of less than 12 μm, high high-temperature sag resistance can be achieved. The result also confirms that when the value is further decreased, the resistance can be further increased.

In Table 2, the comparison between Invented samples 4 and 5 shows that Invented sample 5 containing Co has a smaller residual shearing strain. This result confirms that when a proper amount of Co is added, the high-temperature sag resistance can be improved.

The N content increases in the following order, for example: Comparative sample 3 (0.16 wt %), Invented sample 3 (0.20 wt %), Invented sample 6 (0.25 wt %). In these test pieces, as the N content increases, the residual shearing strain decreases, showing the increase in high-temperature sag resistance. Therefore, it is desirable that the N content be increased. The present inventors studied further and found that it is desirable that the amount of N content be at least 0.18 wt % and at most 0.25 wt %. The upper limit is specified to suppress the generation of blowholes.

TEST EXAMPLE 2

Test pieces having the same chemical composition as that of Invented sample 1 shown in Table 1 were produced by a method similar to that for Invented sample 1. In this test example, however, the surface roughness of the steel wire in the direction of wire drawing was varied from sample to sample. As with Test example 1, the test pieces were formed into a spring and underwent low-temperature annealing to be subjected to an evaluation test for the high-temperature sag resistance. The evaluation results are shown in Table 3. Invented sample 8 was electrolytically polished to give a smooth surface to the steel wire. Comparative sample 5 was abraded with emery paper (#120) to give a coarse surface to the steel wire. The tensile-strength test was conducted at room temperature. The high-temperature sag resistance was evaluated by the same method as in Test example 1.

TABLE 3

| | Surface roughness (in wire-drawing direction) Rz (μm) | Annealing conditions | | Tensile strength ($N/mm^2$) | | Percentage increase in tensile strength (%) | Residual shearing strain (%) |
|---|---|---|---|---|---|---|---|
| | | Temperature (° C.) | Period (min) | Before annealing | After annealing | | |
| Invented sample 1 | 15.4 | 450 | 20 | 1,652 | 1,855 | 12.3 | 0.062 |
| Invented sample 8 | 5.2 | 450 | 20 | 1,643 | 1,842 | 12.1 | 0.052 |
| Comparative sample 5 | 30.3 | 450 | 20 | 1,654 | 1,857 | 12.3 | 0.073 |

Table 3 shows the tensile strength before and after the low-temperature annealing, the percentage increase in tensile strength by the annealing, and the residual shearing strain after the test. As can be seen from Table 3, as the surface roughness of the steel wire in the direction of wire drawing decreases, the residual shearing strain decreases, showing the increase in high-temperature sag resistance. The present inventors studied further and found that the surface roughness Rz of 20 μm or less produces excellent high-temperature sag resistance.

TEST EXAMPLE 3

Test pieces having the same chemical composition as that of Invented sample 1 shown in Table 1 were produced by a method similar to that of Test example 1. In this test example, however, the temperature for the low-temperature annealing after the spring formation was varied from sample to sample as follows: 400, 450, 500, 550, 600, and 650° C. Then, the high-temperature sag resistance was evaluated. The evaluation results are shown in Table 4. Invented sample 9 was annealed at 400° C., Invented sample 10 at. 500° C., Invented sample 11 at 550° C., Invented sample 12 at 600° C., and Invented sample 13 at 650° C. The tests were conducted by the same method as in Test example 1.

TABLE 4

| | Annealing conditions | | Tensile strength ($N/mm^2$) | | Percentage increase | Residual |
|---|---|---|---|---|---|---|
| | Temperature (° C.) | Period (min) | Before annealing | After annealing | in tensile strength (%) | shearing strain (%) |
| Invented sample 9 | 400 | 20 | 1,652 | 1,812 | 9.7 | 0.073 |
| Invented sample 1 | 450 | 20 | 1,652 | 1,855 | 12.3 | 0.062 |
| Invented sample 10 | 500 | 20 | 1,652 | 1,911 | 15.7 | 0.048 |
| Invented sample 11 | 550 | 20 | 1,652 | 1,903 | 15.2 | 0.052 |
| Invented sample 12 | 600 | 20 | 1,652 | 1,839 | 11.3 | 0.058 |
| Invented sample 13 | 650 | 20 | 1,729 | 1,919 | 11.0 | 0.068 |

Table 4 shows the tensile strength before and after the low-temperature annealing, the percentage increase in tensile strength by the annealing, and the residual shearing strain after the test. As can be seen from Table 4, Invented samples 1 and 10 to 12, tempered at 450 to 600° C., have a lower residual shearing strain and hence show that they have excellent high-temperature sag resistance. In particular, Invented samples 10 and 11, tempered at 500 to 550° C., have a percentage increase in tensile strength of more than 15% and show that they have a higher high-temperature sag resistance than the other samples.

The effect of the tensile-strength increase after the foregoing heat treatment (low-temperature annealing) on the improvement of the high-temperature sag resistance was also confirmed by samples having a different degree of processing (reduction of area: 50% and 70%). These results revealed that when the tensile strength increases by 15% or more after the annealing, a sufficient Cottrell effect is formed.

TEST EXAMPLE 4

Test pieces having the same chemical composition as that of the test pieces shown in Table 1 were produced by a method similar to that of Test example 1. In this test example, however, the test pieces had a deformed cross section such as a rectangular or trapezoidal cross section. As with Test example 1, the test pieces were formed into a spring and underwent low-temperature annealing to be subjected to an evaluation test for the high-temperature sag resistance. The evaluation results confirmed that as with Test example 1, Invented samples are superior to Comparative samples in high-temperature sag resistance.

TEST EXAMPLE 5

Test pieces having the same chemical composition as that of the test pieces shown in Table 1 were produced. In this test example, however, the tensile strength of the test pieces was changed from that of Test example 1 by changing the conditions for the solution treatment, the reduction of area at the time of wire drawing, and the wire temperature during the drawing. For one group of test pieces, the tensile strength was reduced to about 1,350 $N/mm^2$. This was achieved by reducing the reduction of area to less than about 60% and reducing the wire temperature during the drawing to suppress the generation of strain aging. In this case, the temperature for the solution treatment was reduced to attain a crystal-grain diameter comparable to that of the corresponding test piece in Test example 1. For another group of test pieces, the tensile strength was increased to about 1,950 $N/mm^2$. This was achieved by increasing the reduction of area to more than about 60% and raising the wire temperature during the drawing to 180° C. to promote the generation of strain aging. In this case, the temperature for the solution treatment was raised to attain a crystal-grain diameter comparable to that of the corresponding test piece in Test example 1. As with the other test examples, the tensile strength was measured at room temperature. As with Test example 1, the test pieces were formed into a spring and underwent low-temperature annealing to be subjected to an evaluation test for the high-temperature sag resistance. The evaluation results showed the same tendency as that attained in Test example 1.

INDUSTRIAL APPLICABILITY

As explained above, the steel wire of the present invention for heat-resistant springs can have both excellent high-temperature tensile strength and excellent high-temperature sag resistance at a temperature of 350 to 500° C., particularly at 400° C. or so. This excellent property is achieved both by controlling the structure of the γ phase (austenite) through an addition of a comparatively large amount of N to an Fe-based austenitic stainless steel and by performing the solid solution hardening with elements that form an interstitial solid solution, such as N, and ferrite-forming elements, such as Mo, Nb, Ti, and Si. In particular, the reduction in stacking-fault energy by the addition of Co and the formation of a Cottrell effect by the heat treatment enable the attainment of the excellent heat-resistant quality at a lower cost than ordinary heat-resistant stainless steels such as SUS 304 and SUS 316.

The steel wire of the present invention is made of a solid solution-hardened alloy. Therefore, in comparison with a precipitation-hardened alloy, it can be produced with a high yield, accompanied by the suppression of the cost increase. In other words, it has high industrial importance.

The steel wire of the present invention has a reduced surface roughness. Therefore, it can reduce the stress concentration after the spring formation, suppressing the generation of local sags. As a result, it can have excellent heat-resistance quality.

As explained above, the steel wire of the present invention particularly has excellent high-temperature sag resistance at 400° C. or so. Therefore, it is most suitable to use as a material for heat-resistant springs to be used in parts for the exhaust system of automobiles, such as ball joints and blades in flexible joints and knitted-wire-mesh springs for supporting three-way catalysts.

The invention claimed is:

1. A steel wire for heat-resistant springs, the steel wire containing:

(a) 0.01 to 0.08 wt % C, 0.18 to 0.25 wt % N, 0.5 to 4.0 wt % Mn, 16 to 20 wt % Cr, 8.0 to 10.5 wt % Ni, and 0.2 to 2.0 wt % Co;

(b) at least one constituent selected from the group consisting of 0.1 to 3.0 wt % Mo, 0.1 to 2.0 wt % Nb, 0.1 to 2.0 wt % Ti and 0.3 to 2.0 wt % Si; and (c) mainly Fe and unavoidable impurities both of which constitute the remainder;

the steel wire having:

(d) a tensile strength of at least 1,300 N/mm$^2$ and less than 2,000 N/mm$^2$ before being treated by low-temperature annealing;

(e) a maximum crystal-grain diameter of less than 12 μm in the γ phase (austenite) in a transverse cross section of the wire; and (f) a surface roughness, expressed as Rz, of 1 to 20 μm, the surface roughness being defined as a roughness in the direction of wire drawing.

2. A steel wire as defined by claim 1, wherein the shape of the transverse cross section of the steel wire is selected from the group consisting of a square, rectangle, trapezoid, ellipse, and oval.

3. A method for producing a heat-resistant spring, the method comprising the steps of:

(a) forming a spring by using a steel wire containing:

(a1) 0.01 to 0.08 wt % C, 0.18 to 0.25 wt % N, 0.5 to 4.0 wt % Mn, 16 to 20 wt % Cr, 8.0 to 10.5 wt % Ni, and 0.2 to 2.0 wt % Co;

(a2) at least one constituent selected from the group consisting of 0.1 to 3.0 wt % Mo, 0.1 to 2.0 wt % Nb, 0.1 to 2.0 wt % Ti and 0.3 to 2.0 wt % Si; and (a3) mainly Fe and unavoidable impurities both of which constitute the remainder;

the steel wire having:

(a4) a tensile strength of at least 1,300 N/mm$^2$ and less than 2,000 N/mm$^2$ before being treated by low-temperature annealing; and (a5) a maximum crystal-grain diameter of less than 12 μm in the γ phase (austenite) in a transverse cross section of the wire; and (a6) a surface roughness, expressed as Rz, of 1 to 20 μm. the surface roughness being defined as a roughness in the direction of wire drawing; and (b) treating the spring with low-temperature annealing at a temperature of 450 to 600° C., wherein the step of forming the spring includes performing solution treatment at a temperature of 950 to 1.200° C., a temperature-maintaining period of which is 0.3 to 5 min/mm, the temperature-maintaining period being expressed by a ratio of maintaining period (mm) and wire diameter (mm), and controlling wire drawing reduction of area to be within 50 to 70%.

4. A method as defined by claim 3, wherein the low-temperature annealing is performed at a temperature of 500 to 550° C. so as to increase the tensile strength of the steel wire by at least 15%.

5. A method for producing a heat-resistant spring, the method comprising the steps of:

forming a spring by using a steel wire containing (a) 0.01 to 0.08 wt % C, 0.18 to 0.25 wt % N, 0.5 to 4.0 wt % Mn, 16 to 20 wt % Cr, 8.0 to 10.5 wt % Ni, and 0.2 to 2.0 wt % Co, (b) at least one constituent selected from the group consisting of 0.1 to 3.0 wt % Mo, 0.1 to 2.0 wt % Nb, 0.1 to 2.0 wt % Ti and 0.3 to 2.0 wt % Si, and (c) mainly Fe and unavoidable impurities both of which constitute the remainder;

the steel wire having (d) a tensile strength of at least 1,300 N/mm$^2$ and less than 2,000 N/mm$^2$ before being treated by low-temperature annealing, (e) a maximum crystal-grain diameter of less than 12 μm in the γ phase (austenite) in a transverse cross section of the wire, and (f) a surface roughness, expressed as Rz, of 1 to 20 μm, the surface roughness being defined as a roughness in the direction of wire drawing; and treating the spring with low-temperature annealing at a temperature of 450 to 600°C.

6. A steel wire for heat-resistant springs, the steel wire containing:

(a1) 0.01 to 0.08 wt % C, 0.18 to 0.25 wt % N, 0.5 to 4.0 wt % Mn, 16 to 20 wt % Cr, 8.0 to 10.5 wt % Ni, and 0.2 to 2.0 wt % Co;

(a2) at least one constituent selected from the group consisting of 0.1 to 3.0 wt % Mo, 0.1 to 2.0 wt % Nb, 0.1 to 2.0 wt % Ti and 0.3 to 2.0 wt % Si; and (a3) mainly Fe and unavoidable impurities both of which constitute the remainder;

the steel wire having:

(a4) a tensile strength of at least 1,300 N/mm$^2$ and less than 2,000 N/mm$^2$ before being treated by low-temperature annealing;

(a5) a maximum crystal-grain diameter of less than 12 μm in the γ phase (austenite) in a transverse cross section of the wire; and (a6) a surface roughness, expressed as Rz, of 1 to 20 μm, the surface roughness being defined as a roughness in the direction of wire drawing, wherein solution treatment is performed at a temperature of 950 to 1,200 0C, a temperature-maintaining period of which is 0.3 to 5 min/mm, the temperature-maintaining period being expressed by a ratio of maintaining period (min) and wire diameter (mm), and wire drawing reduction of area is controlled to be within 50 to 70%.

* * * * *